US007097727B2

(12) United States Patent
Podominick et al.

(10) Patent No.: US 7,097,727 B2
(45) Date of Patent: Aug. 29, 2006

(54) INLINE ACCUMULATING DIE PADDER

(75) Inventors: Charles R. Podominick, St. Paul, MN (US); Caley J. Schwalm, Cotati, CA (US)

(73) Assignee: 3M Innovative Properties Company, St. Paul, MN (US)

( * ) Notice: Subject to any disclaimer, the term of this patent is extended or adjusted under 35 U.S.C. 154(b) by 39 days.

(21) Appl. No.: 10/430,777

(22) Filed: May 6, 2003

(65) Prior Publication Data

US 2004/0221946 A1 Nov. 11, 2004

(51) Int. Cl.
*B29C 65/00* (2006.01)

(52) U.S. Cl. ..... 156/250; 156/261; 156/269; 83/23; 83/29; 83/37

(58) Field of Classification Search ..... 156/89.11, 156/250, 251, 256, 260, 261, 264, 269; 428/201, 428/202; 83/13, 23, 29, 37, 54, 123, 126, 83/38, 30; 30/278, 314, 315; 283/61, 101, 283/117; 462/72; 281/15.1
See application file for complete search history.

(56) References Cited

U.S. PATENT DOCUMENTS

| | | | | |
|---|---|---|---|---|
| 1,596,926 | A | 8/1926 | Furber | |
| 2,433,535 | A * | 12/1947 | Treis et al. | 83/134 |
| 2,444,019 | A | 6/1948 | Krueger | |
| 2,966,085 | A | 12/1960 | Hanson | |
| 3,555,949 | A | 1/1971 | Treff | |
| 3,670,612 | A | 6/1972 | Johnson et al. | |
| 3,691,140 | A | 9/1972 | Silver | |
| 3,789,711 | A | 2/1974 | Mead | |
| 3,826,170 | A | 7/1974 | Jones et al. | |
| 3,857,731 | A | 12/1974 | Merrill, Jr. et al. | |
| 4,105,224 | A | 8/1978 | Rodebaugh et al. | |
| 4,166,152 | A | 8/1979 | Baker et al. | |
| 4,171,081 | A | 10/1979 | Vossen et al. | |
| 4,189,339 | A | 2/1980 | Loeffler et al. | |
| 4,203,334 | A | 5/1980 | Zettler | |
| 4,341,735 | A | 7/1982 | Seifried | |
| 4,416,392 | A | 11/1983 | Smith | |
| 4,543,865 | A | 10/1985 | Kramski | |
| 4,662,970 | A | 5/1987 | Bancroft | |
| 4,738,745 | A | 4/1988 | Fuzuzaki et al. | |
| 4,743,319 | A | 5/1988 | Ramcke | |
| 4,770,320 | A | 9/1988 | Miles et al. | |
| 4,779,401 | A | 10/1988 | Pedersen | |
| 4,781,306 | A | 11/1988 | Smith | |
| 4,786,696 | A | 11/1988 | Bohnel | |

(Continued)

FOREIGN PATENT DOCUMENTS

| | | |
|---|---|---|
| DE | 200 15 473 U1 | 1/2001 |

(Continued)

*Primary Examiner*—Chris Fiorilla
*Assistant Examiner*—Sue A. Purvis

(57) ABSTRACT

A pad forming process forms a stack of sheets, each sheet bearing adhesive on at least a portion of one side thereof. A sheet cutting die is provided having sheet collection cavity therein. A web comprising a linerless elongated sheeting having one side at least partially covered with an adhesive is advanced past the die. The die cuts the web to form a first cut sheet which is retained within the sheet collection cavity of the die. The web continues to advance past the die. The die then cuts the web to form a second cut sheet from the web which is retained within the sheet collection cavity of the die, wherein the second cut sheet adheres to the first cut sheet within the sheet collection cavity to form a stack of sheets.

23 Claims, 7 Drawing Sheets

U.S. PATENT DOCUMENTS

| | | | | |
|---|---|---|---|---|
| 4,787,282 | A | 11/1988 | Okachi et al. | |
| 4,883,553 | A | 11/1989 | David et al. | |
| 4,907,825 | A | 3/1990 | Miles et al. | |
| 4,959,115 | A * | 9/1990 | Lacy | 156/264 |
| 4,988,567 | A | 1/1991 | Delgado | |
| 4,994,322 | A | 2/1991 | Delgado et al. | |
| 5,045,569 | A | 9/1991 | Delgado | |
| 5,122,029 | A | 6/1992 | DelDuca | |
| 5,150,647 | A | 9/1992 | Mohr | |
| 5,194,299 | A * | 3/1993 | Fry | 427/208.6 |
| 5,417,345 | A | 5/1995 | Smith | |
| 5,484,499 | A | 1/1996 | Marschke | |
| 5,755,355 | A * | 5/1998 | Timmerman et al. | 221/33 |
| 6,063,229 | A | 5/2000 | Miles et al. | |
| 6,179,337 | B1 * | 1/2001 | Zumberge | 283/81 |
| 6,268,032 | B1 | 7/2001 | Mertens et al. | |
| 6,379,764 | B1 | 4/2002 | Pusateri et al. | |
| 6,383,591 | B1 | 5/2002 | Miles et al. | |
| 6,397,715 | B1 | 6/2002 | Roberts | |
| 6,428,248 | B1 | 8/2002 | Lee | |
| 6,544,640 | B1 | 4/2003 | Miles et al. | |

FOREIGN PATENT DOCUMENTS

| | | |
|---|---|---|
| DE | 20015773 U1 * | 1/2001 |
| JP | P2001-121487 A | 5/2001 |
| WO | WO 94/14614 | 7/1994 |

* cited by examiner

INLINE ACCUMULATING DIE PADDER

BACKGROUND OF THE INVENTION

The present invention relates to a process for forming a stack of sheets, one adhered to another, and to an apparatus for cutting web sheeting into a particularly shaped cut sheet to form the stack.

Repositionable sheets, such as the Post-it® brand notes, flags, tags, labels, and tape sold by 3M Company of St. Paul, Minn., are quite common and in everyday use. Such repositionable articles in familiar form are available in stacks or pads of sheets, one adhered to another. A repositionable note sheet has a first side which is partially coated with a repositionable pressure-sensitive adhesive (PSA) and a second side which, when viewed from that side, is either plain (no printing) or has a preprinted message or design thereon. Such a repositionable article is useful for calling attention to a particular section of a document, for marking a page in a document or book, or for leaving a removable and repositionable article that can be adhered to just about any clean surface.

Stacks of sheets using non-repositionable adhesive that is activated once an individual sheet is removed from the stack are available as well. Examples of such uses include, labels or tape using pressure sensitive adhesive which is non-repositionable.

Z-fold stacks of either notes or flags is one common method of stacking pads. A typical manner of packaging tape flags in a Z-fold fashion is disclosed in U.S. Pat. No. 4,770,320, which is incorporated by reference. Various other dispensable sheet material stacks are known in the art, including those disclosed in U.S. Pat. Nos. 4,416,392, 4,781,306, and 5,417,345, which are incorporated herein by reference. Z-folded tape flags, and other repositionable articles, include alternate sheets with adhesive adjacent a common edge and the remaining sheets have adhesive adjacent an opposite edge as the alternate sheets. Such Z-folded stacks are useful for dispensing repositionable articles in dispensers. Relative movement is afforded between a top wall of the dispenser and an uppermost sheet to afford, as the uppermost sheet is pulled through a dispensing slot, alignment of the slot with successive portions of the uppermost sheet toward a second end as the successive portions are peeled from the stack. In a final relative position between the top wall and the uppermost sheet, the dispensing slot is along the second end portion of that sheet and the first end portion of the underlying sheet to cause movement of the first end portion of the underlying sheets through the slot. The second end portion of the uppermost sheet leaves the first end portion of the underlying sheet projecting through the slot after the uppermost sheet is removed.

A process is desired in the art for forming a stack of sheets from a continuously running integral webs of material and processing directly into the shaped pad, rather than forming the pad and then cutting the pad to the desired shape.

BRIEF SUMMARY OF THE INVENTION

The present invention is directed to a method for forming a stack of sheets, each sheet bearing adhesive on at least a portion of one side thereof. A sheet cutting die is provided having a sheet collection cavity therein. A web is advanced past the die wherein the web comprises a linerless elongated sheeting having one side at least partially covered with an adhesive. The die cuts the web to form a first cut sheet which is retained within the sheet collection cavity of the die. The web continues to advance past the die. The die then cuts the web again to form a second cut sheet from the web which is retained within the sheet collection cavity of the die, wherein the second cut sheet adheres to the first cut sheet within the sheet collection cavity to form a stack of sheets.

BRIEF DESCRIPTION OF THE DRAWINGS

The present invention will be further explained with reference to the attached figures, wherein like structure is referred to by like numerals throughout the several views.

While the above-identified drawing figures set forth several embodiments of the invention, other embodiments are also contemplated, as noted in the discussion. In all cases, this disclosure presents the present invention by way of representation and not limitation. It should be understood that numerous other modifications and embodiments can be devised by those skilled in the art which fall within the scope and spirit of the principles of this invention.

DETAILED DESCRIPTION

Figure 1A:
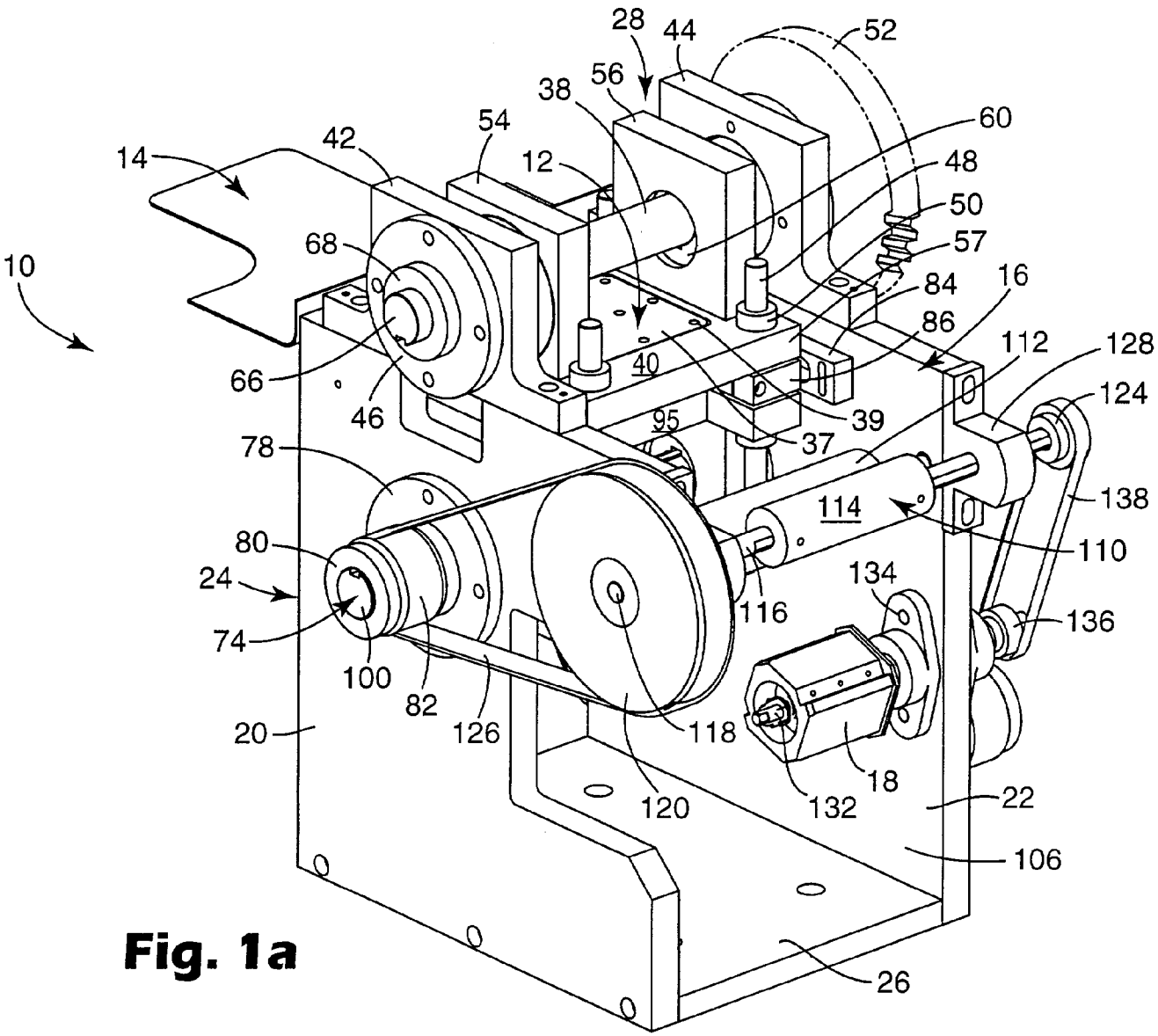
FIGS. 1*a* and 1*b* are side perspective views of an inline cutting station for use in a pad forming process, including an accumulating die padder.
Figure 1B:
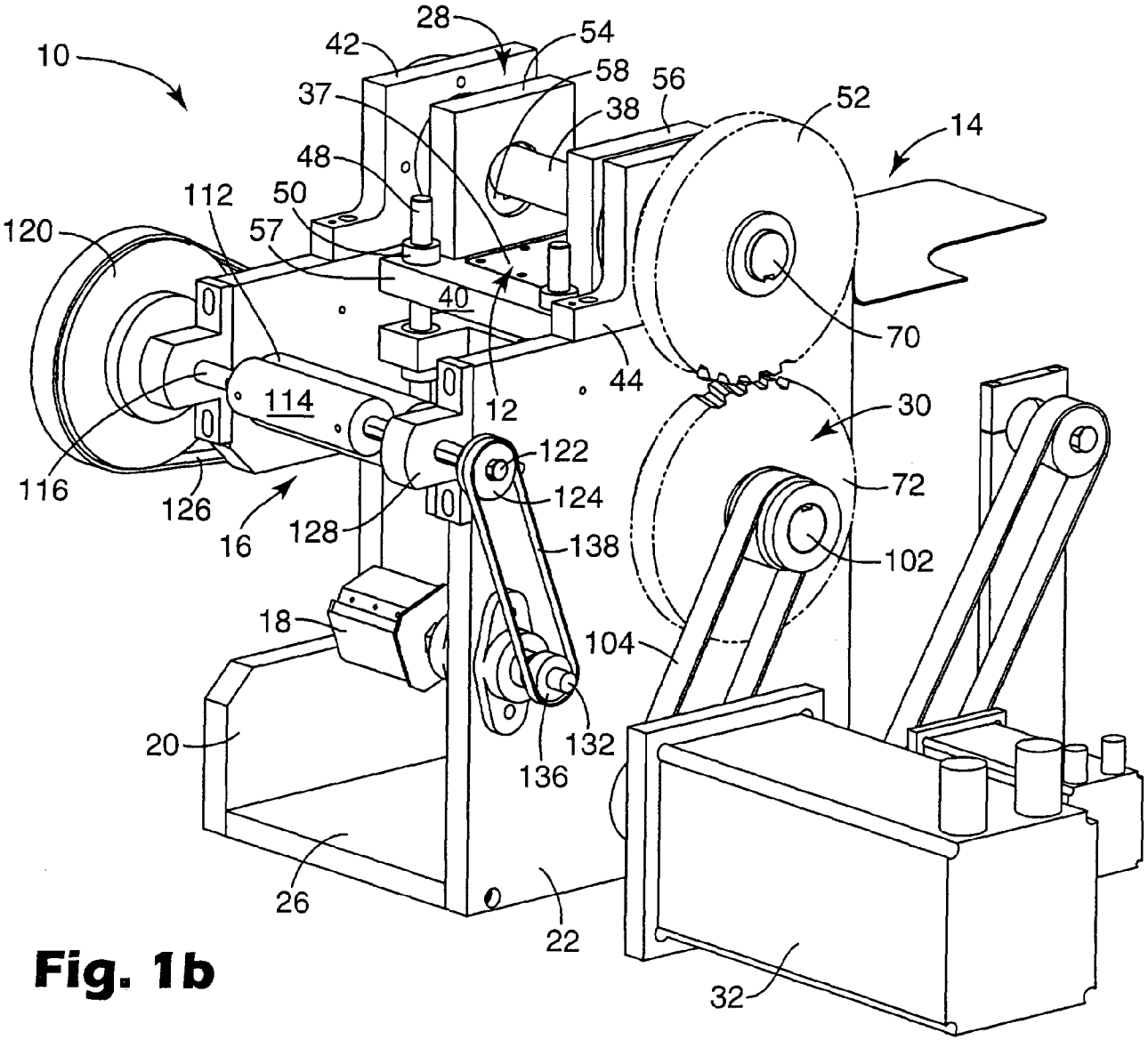
Figure 1C:
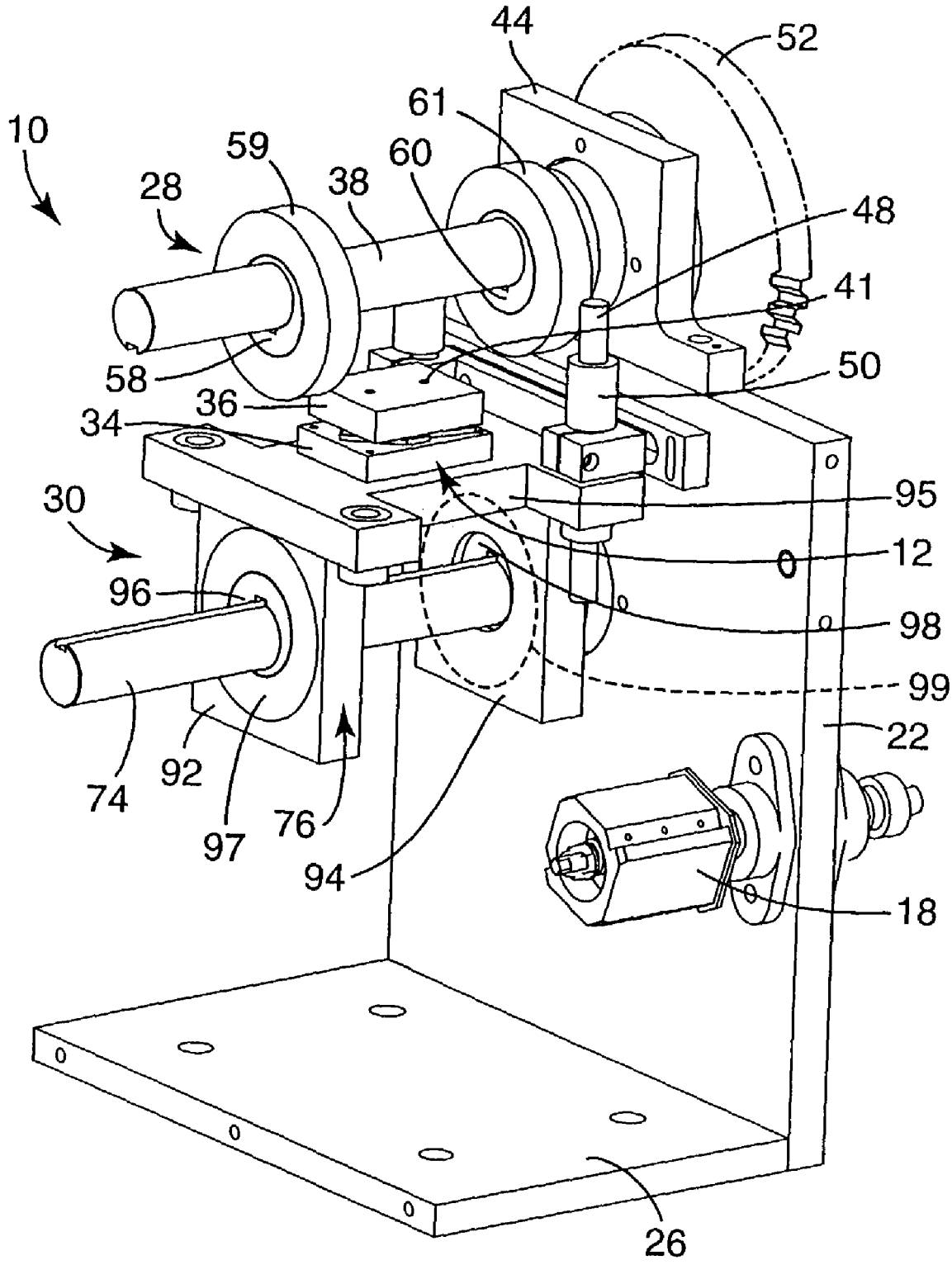
FIG. 1*c* is a side perspective view of the inline cutting station with a portion of the housing and upper drive assembly removed.

FIGS. 1*a*, 1*b* and 1*c* are side perspectives view (from opposite sides) of an inline cutting station 10 for use in a pad forming process. The cutting station 10 includes an accumulating die assembly 12 to cut sheets of any shape or quantity from an adhesive coated web sheeting (not shown) and to assemble those sheets to form a padded product. The cutting station 10 includes a feed end 14 and a discharge end 16. An adhesive coated substrate, i.e. web sheeting, enters the cutting station 10 at the feed end 14 and the sheeting is cut by the die assembly 12 into cut sheets and formed into shaped pads of cut sheets. The discharge end 16 includes a weed roll 18 for retaining weed web sheeting. The cut sheets are captured within the die assembly 12 to stack the cut sheets and form shaped pads, which are thereby ejected from the die assembly 12. The cutting station 10 includes an operator side plate 20 and a drive side plate 22 defining sidewalls of a housing 24 of the cutting station 10. The housing 24 is further defined by a bottom plate 26 connecting the operator and drive side plates 20, 22. The cutting station 10 includes an upper drive assembly 28 and a lower drive assembly 30. The drive assemblies 28, 30 are driven by a motor 32 to cut the web sheeting with the die assembly 12 and advance the web sheeting through the cutting station 10.

The web sheeting is a substrate sheeting material from which cut sheets are cut from to form a padded product and the weed web is the remaining portion of the sheeting after the cut is made. The web sheeting is typically linerless and bears an adhesive on one side thereof. Examples of the web sheeting material include, unsaturated paper, opaque paper, conventional bond or clear coated paper, carbonless paper, a polymeric sheet material or even a metallic foil. The adhesive is either repositionable or non-repositionable, and may be permanent, pressure activated, or heat activated.

Figure 2:
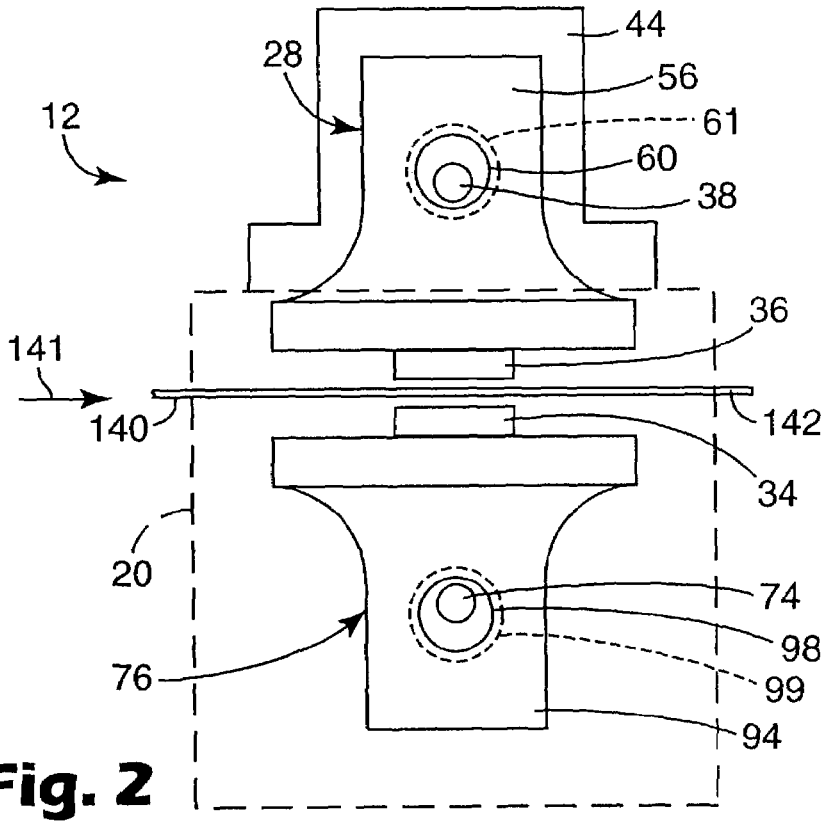
FIG. 2 is a side elevational view of the cutting station, with the die in a first position for advancing a web sheeting.
Figure 3:
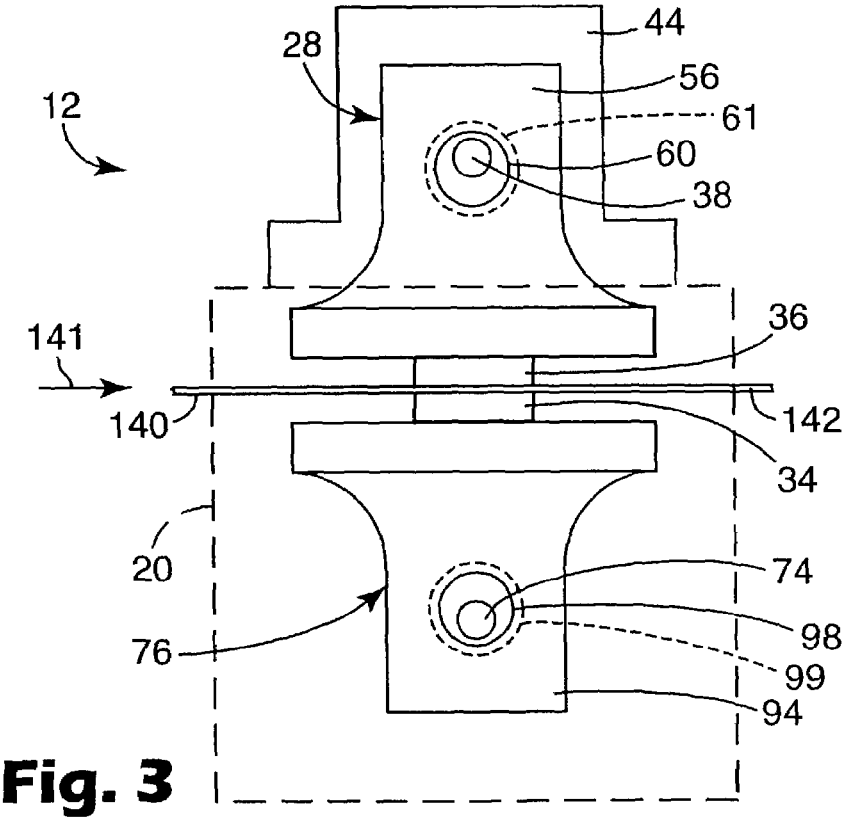
FIG. 3 is a side elevational view of the cutting station, with the die in a second position for cutting the web sheeting.

The adhesive coated substrate is fed into the cutting station 10 at the feed end 14 from a stock roll (not shown). The substrate advances past the die assembly 12 (from left to right in FIG. 1*a*) and is cut into shaped sheets. The weed substrate exits the cutting station 10 at the discharge end 16 and is wound on the weed roll 18. The web sheeting passes through a die assembly 12 comprised of the die padder 34 (or cutting block) and an anvil 36 (or a chopping block). The sheeting passes between the die 34 and the anvil 36 of the die assembly 12 where the sheeting is cut into a cut sheet having a desired shape defined by the die 34. The die 34 and anvil 36 move in a reciprocating relationship to cut the sheeting. The die 34 and anvil 36 move eccentrically towards each other to cut the sheeting and then move eccentrically apart to release and advance the sheeting such that another portion of the sheeting may be cut by the die assembly 12 (as shown in FIGS. 2 and 3). The anvil 36 of the die assembly 12 is associated with the upper drive assembly 28 and the die 34 is associated with the lower drive assembly 30. In alternate embodiments of the present invention, the die 34 is associated with the upper drive assembly 28 and the anvil 36 is associated with the lower drive assembly 30, or the anvil 36 is stationary and the die 34 moves non-eccentrically.

In the embodiment shown in FIGS. 1*a*, 1*b*, 1*c*, 2 and 3, the upper drive assembly 28 is comprised of an upper drive shaft 38, an upper stage 40, first and second bearing housings 42 and 44, an upper flange bearing 46, a die guide 48, a super ball bushing 50, and an upper gear 52. The upper stage 40 supports a tramming block 37, which is used to level and shim the die 34. The anvil 36 is attached to the tramming block by bolts (not shown) adapted to be received by bores 39 within the tramming block 37 and bores 41 within the anvil 36. The upper stage 40 includes a first portion 54 and a second portion 56, which extend perpendicularly from a base 57 of the upper stage 40. Upper drive shaft 38 is supported by first and second bearing housings 42, 44, which are attached to top surfaces of the operator and drive side plates 20, 22. Keyed to the upper drive shaft 38 are two eccentric cam lobes 58 and 60. The cam lobes 58, 60 have round inner and outer diameters, however the two diameters are not concentric. The eccentricity of the cam lobes transmits power from the motor 32 to the anvil 34 and die 36. Encompassing the eccentric cam lobes 58 and 60 are radial ball bearings 59 and 61. The upper stage 40 is press fit onto ball bearings 59 and 61.

A first end 66 of the upper drive shaft 38 is terminated at the flange bearing 46 and bushing 68 proximate the first bearing housing 42. The upper drive shaft 38 passes through the first bearing housing 42, the eccentric cam lobe 58 of the first upper stage member 54, the eccentric cam lobe 60 of the second upper stage member 56 and the second bearing housing 44. A second end 70 of the upper drive shaft 38 is terminated at the upper gear 52. The upper gear 52 is rotated in conjunction with a lower gear 72 associated with the lower drive assembly 30 to rotate the upper drive shaft 38 and reciprocate movement of the chopping block 36 with respect to the cutting block, or die 34.

The lower drive assembly 30 is comprised of a lower drive shaft 74, a lower stage 76, a flange bearing 78, a bushing 80, a pulley 82, a cam track 84 and a slider 86. The die 34 of the die assembly 12 is attached to the lower stage 76. The lower stage 76 includes a first portion 92 and a second portion 94, which extend perpendicularly from a base 95 of the lower stage 76. Lower drive shaft is supported by side plates 20, 22. Keyed to the lower drive shaft are two eccentric cam lobes 96 and 98. The cam lobes 96, 98 have round inner and outer diameters, however the two diameters are not concentric. The eccentricity of the cam lobes transmits power from the motor to the anvil 34 and the die 36. Encompassing the eccentric cam lobes 96, 98 are radial ball bearings 97, 99. The lower stage 76 is press fit onto ball bearings 97, 99.

A first end 100 of the lower drive shaft 74 is terminated at the flange bearing 78, bushing 80, and pulley 82 adjacent the operator side plate 20 of the housing 24. The lower drive shaft 74 passes through the operator side plate 20, the eccentric cam lobe 96 of the first lower stage member 92, the eccentric cam lobe 98 of the second lower stage member 94, and the drive side plate 22. A second end 102 of the lower drive shaft 74 is terminated at the lower gear 72, which is engaged with the upper gear 52. The lower gear 72 is interconnected with and driven by the motor 32 with a drive belt 104. The motor 32 rotates the lower gear 72, which is engaged with the upper gear 52, and thereby rotates the upper gear 52. The lower gear 72 drives die 34 of the die assembly 12 and the upper gear 52 drives the anvil 36 in a reciprocating relationship following an elliptical path.

The cam track 84 is attached to an inner wall 106 of the drive side plate 22 of the housing 24 adjacent the die 34 of the die assembly 12. The slider 86 is associated with the die 34 and includes a cam follower which rides in the cam track 84 to follow the horizontal movement of the lower drive assembly 30. The die 34 and anvil 36 of the die assembly 12 are aligned and connected together in parallel planes by at least one die guide 48 and the ball bushing 50 with relative vertical movement allowed therebetween.

A pull roller assembly 110 is located at the discharge end 16 of the cutting station 10 and is interconnected with the lower drive assembly 30. An idle roller 112 is mounted within the housing 24 between the operator side plate 20 and the drive side plate 22. Located adjacent the idle roller 112 is a pull roller 114. A pull shaft 116 passes through the pull roller 112 and is mounted within the housing 24 between the housing side plates 20, 22. A first end 118 of the pull shaft 116 is terminated at a pulley 120 at the operator side plate 20 and a second end 122 of the pull shaft 116 is terminated at a pulley 124 proximate the drive side plate 22. The pulley 120 is interconnected with the pulley 82 of the lower drive assembly 30 by a drive belt 126 and is driven by the lower drive shaft 74 to rotate the pull roller 114. The second end 122 of the pull shaft 116 passes through a pillow block 128 mounted to the drive side plate 22 of the housing 24 and is terminated at the pulley 124.

Located at the discharge end 16 of the cutting station 10 is the weed take-up drum 18, which is mounted to a drum shaft 132. The drum shaft 132 passes through a flange bearing 134 (mounted to the inner wall 106 of the drive side plate 22) and the drive side plate 22. One end of the drum shaft 132 is terminated at the drum 18 and an opposite end is terminated at a pulley 136. A drive belt 138 passes around the pulley 124, connected to the pull shaft 116, and the pulley 136, connected to the drum shaft 132. Rotation of the pull shaft 116 by the lower drive assembly 30 rotates the drum 18, via the drum shaft 132. After the weed sheeting exits the die assembly 12, the weed passes between the idle roller 112 and the pull roller 114, around the pull roller 114 and is wound around the drum 18. The upper and lower drive assemblies 28, 30 are driven at approximately the same speed as the web is advanced through the cutting station 10. The eccentric cutting improves web handling and pad making by following the web.

FIGS. 2 and 3 are side elevational views of the inline cutting station 10 with the die 34 in a first release position and a second cut position, respectively. A web sheeting 140 advances in the direction of arrow 141 through the die assembly 12, past the die 34, which cuts the web 140 into shaped cut sheets, and the remaining web waste or weed 142 is then wound around the drum 18. The web 140 passes between the die 34 and the anvil 36 of the die assembly 12. The anvil 36 of the upper drive assembly 28 and the die 34 of the lower drive assembly 30 move in reciprocating directions based upon the shape of the eccentric cam lobes of the upper and lower stages. The die cuts the web sheeting 140 against the anvil. The upper shaft 38 cycles counterclockwise such that the upper stage 40 and the anvil 36 travel along an elliptical path. The lower shaft 74 cycles clockwise such that the lower stage 76 and the die 34 travel along an elliptical path.

In the release position (FIG. 2), the upper drive assembly 28 is at the uppermost position of the rotation and the lower drive assembly 30 is at the lowermost position of the rotation. When the die assembly 12 is in the release position, and in particular when the die assembly 12 is not in the cut position, the web 140 is capable of advancing past the die 34.

In the cut position shown in FIG. 3, the upper drive assembly 28 is at the lowermost position of the rotation and the lower drive assembly 30 is at the uppermost position. In the cut position, the die 34 and the anvil 36 meet to cut the web 140 therebetween and form a cut sheet. Rotation of the lower drive shaft 74 rotates the pull roller 114 via the drive belt 126 and pull shaft 116, which in turn rotates the weed take-up drum 18 via the drive belt 138 and the drum shaft 132. The interconnected shafts 38, 74, 116 and 132 advance the web sheeting 140 through the cutting station 10 at the same speed as the die assembly 12 is eccentrically rotated.

Figure 4:
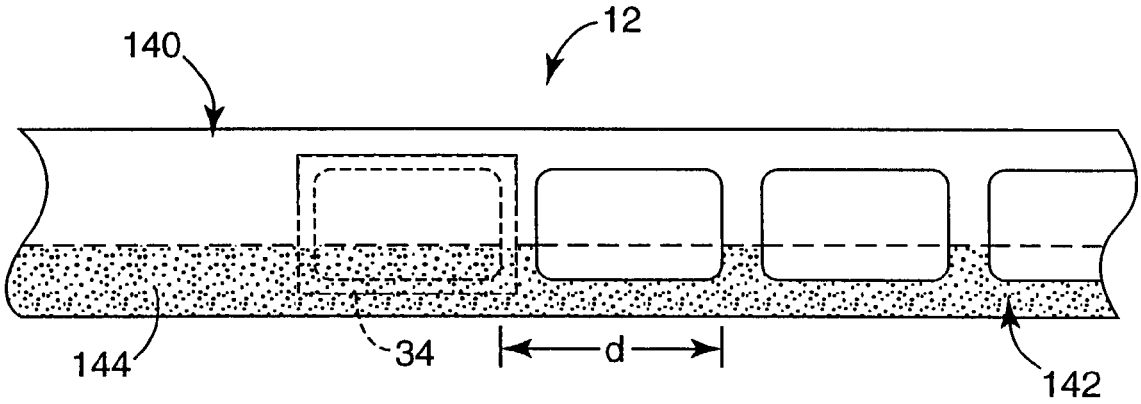
FIG. 4 is a bottom schematic view of the web sheeting advancing past the die.

FIG. 4 is a bottom schematic view of the web sheeting 140 advancing through the cutting station 10 and past the die 34 (shown by dashed lines). An adhesive 144 on one side of the web sheeting 140 is shown by stipling. After the web sheeting 140 is cut by the die 34, the weed portion 142 advances past the die 34, exits the discharge end 16 of the cutting station 10 and is captured by and wound about the drum 18 to form a weed roll. In an alternate embodiment of the present invention, the adhesive strip runs in the width direction of the web sheeting 140 and the die 34 is timed to cut the web and adhesive to form a cut sheet.

Figure 5:
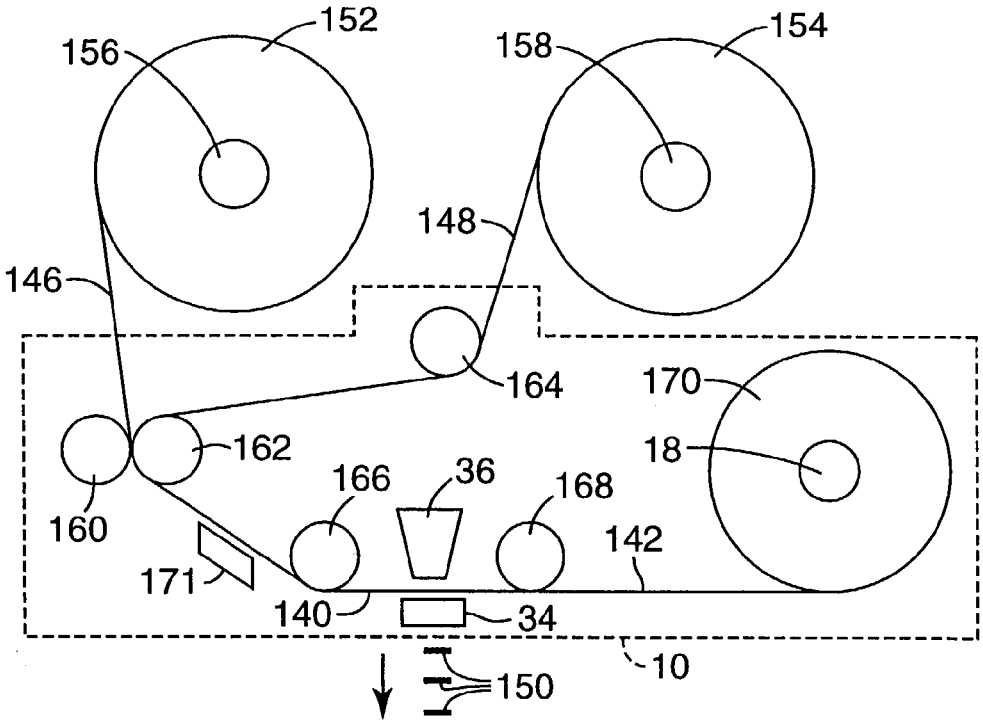
FIG. 5 is a schematic diagram of the web sheeting advancing through the cutting station.

The present invention includes a process for forming a stack of shaped cut sheets, each sheet bearing an adhesive on one side of the sheet (i.e., on at least a portion of the sheet or an entire side of the sheet) such that the cut sheets adhere together to form a stack of sheets or pad. FIG. 5 is a schematic diagram of web 140 comprised of two elongated linerless sheeting 146, 148 passing through the cutting station 10 and past the die assembly 24. Although the inventive process has been discussed with respect to advancing the web 140 comprised of a single sheeting through the cutting station 10 and past the die 34, further embodiments of the invention may include a web comprised of more than one elongated sheeting passing through the cutting station to be cut by the die in a single cut. The number of sheetings is preferably an even number (such as 2, 4 or 6), however, an odd number of sheetings may be used as well.

FIG. 5 illustrates the process for forming a stack 150 of shaped cut sheets from stock rolls 152, 154 of elongated linerless sheeting. Each roll 152, 154 of sheeting is retained on a spindle 156, 158 proximate the cutting station 10. The first stock roll 152 of sheeting 146 and the second stock roll 154 of sheeting 148 are used to supply the sheeting. The sheeting 146, 148 follows a web path through the cutting station 10, which includes a plurality of rollers to advance the sheeting 146, 148 through the cutting station 10. The sheeting 146 supplied by the first stock roll 152 passes between a pinch roller 160 and a drive roller 162. The sheeting 148 supplied by the second stock roll 154 passes around a drive roller 164 and then between the pinch roller 160 and the drive roller 162, such that the first sheeting 146 and the second sheeting 148 meet to form the web 140. The adhesive 144 on at least one of the sheetings adheres the sheetings 146, 148 together. The web 140 then passes around a drive roller 166 before advancing past the die 34.

As the web 140 advances past the die 34, the die 34 and anvil 36 move towards each other to meet, cut the web 140 and form a cut sheet (as shown in FIGS. 2 and 3). The cut sheet is retained within a sheet collection cavity 178 (shown in FIG. 6) within the die 34. After the cut sheet is separated from the web 140, the web 140 advances a sufficient distance such that a subsequent complete cut sheet may be cut from the web 140 (such as distance d shown in FIG. 4). The weed portion 142 of the web 140 passes around a drive roller 168 and is wound about a weed roll 170 mounted to the spindle 18. The subsequent cut sheet adheres to the initial cut sheet within the sheet collection cavity in the die 34 to form a stack of sheets. The stack 150 of sheets, or shaped pad, is discharged from the die 34 once a desired number of sheets are stacked and adhered together. Further embodiments of the cutting station may include differing configurations of the rollers to advance the sheeting and web through the cutting station.

To differentiate multiple pads from each other, the adhesive on an adhesive bearing side of either the final cut sheet in each pad or the initial cut sheet in each pad is deactivated to prevent adhesion. The web 140 advances past deactivation station 171 where a portion of the adhesive on the adhesive bearing side of the web is deactivated. One method for deactivating the adhesive on a cut sheet is to apply a backing sheet or liner to the adhesive of a portion of the web sheeting prior to cutting the sheeting. The backing sheet is cut with the web and adheres to the cut sheet to differentiate one pad from a subsequent or previous pad. Another method for deactivating the adhesive is to temporarily or permanently detackify, or remove, the adhesive from a portion of the web sheeting prior to cutting the web to form a cut sheet. For example, to differentiate one pad from a subsequent or previous pad, the adhesive on a portion of the sheeting, and for a particular cut sheet, is detackified.

The web substrate sheeting is elongated in a longitudinal direction (in the direction of web travel). The substrate sheeting is typically linerless and bears an adhesive, either repositionable or non-repositionable, on one side thereof. The web substrate may be provided in strip form or provided in a roll which is rotatably mounted on a spindle supported by suitable means on a portion of the cutting station. The sheeting is referred to "elongated" because it is not yet cut into a discrete sheet having a desired shape, and thus the length of the elongated sheeting, as its name applies, is much greater than its width. The term "linerless" is used herein to mean an adhesive on the sheeting is exposed from the time the sheeting is supplied with the adhesive secured thereto (e.g., comes off a supply roll) to the die assembly for forming a stack of cut sheets. The sheeting is not considered to be linerless when a liner covering the adhesive is removed to expose the adhesive on the sheeting just prior to cutting the sheeting.

The elongated, linerless sheeting is positioned on the roll with one side (e.g., the adhesive bearing side) facing the center of the roll and a top side (e.g., blank or information bearing side) facing the periphery of the roll. The cut sheets are cut from the sheeting by the die and captured within the die (shown in FIG. 7). Adjacent cut sheets adhere together and are stacked upon previously cut sheets to form a pad. An adhesive bearing side of the cut sheet corresponds to the adhesive bearing side of the sheeting, while a top side of the cut sheet corresponds to the top side of the sheeting. The top side of the sheeting may have a release coating, also known as a low-adhesion backsize coating, thereon to facilitate unwinding of the sheeting from the roll (and later, to facilitate the separation of each cut sheet from its respective pad). Such a low-adhesion backsize coating may include silicone polymers, fluorocarbon polymers, urethanes, acrylates, and chrome complexes.

The adhesive is preferably either a repositionable adhesive or a non-repositionable adhesive. The term "repositionable" means the sheet can be adhered to and removed from the clean solid surface at least two times without substantially losing tack. Preferably, the sheet can be adhered to and removed from the clean solid surface at least 10 times and, more preferably, more than 20 times without substantially losing tack. Other useful non-repositionable adhesives include high peel adhesives that may permanently attach a sheet. Examples of such adhesives include rubber resin and acrylic adhesives. In one embodiment, a sheet with non-repositionable adhesive may temporarily be stored in a pad form, or stack of sheets, if the non-repositionable adhesive of the sheet is adhered to a surface of another sheet having a low to medium adhesion backsize coating to facilitate removal of the non-repositionable sheet from the pad.

A repositionable sheet formed from this process may be a Post-it® brand note, flag, tag, label or tape sold by 3M Company, St. Paul, Minn. Each Post-it® brand note includes a sheet that has an adhesive partially disposed on one side thereof. The sheet is typically an unsaturated paper, which is paper that is not impregnated with a resin. The adhesive is coated as a narrow band adjacent one edge of the sheet, although other embodiments are possible, such as where only corners or other portions (or even all) of the adhesive bearing side of the sheet is coated with an adhesive. The sheet may be coated with a primer to enhance the anchorage of the adhesive to the substrate sheeting. The amount of adhesive on the adhesive bearing side of the repositionable sheet must be sufficient to enable the sheet to adhere to a clean surface.

In addition to opaque or paper cut sheets, such as a Post-it® brand notes, the present invention is also applicable to other sheet structures. The present invention is applicable to any sheeting material with an adhesive applied to at least a portion of one side, or even both sides, of the sheeting material. The sheeting material is then cut to form individual cut sheets of a desired shape which adhere together to form a shaped pad. The sheeting material may be conventional bond or clear coated paper, carbonless paper, a polymeric sheet material or even a metallic foil. Furthermore, transparent or translucent substrate materials (i.e., light transmissive) such as those used for Post-it® brand tape flags brand index tabs or brand highlighting arrows sold by 3M Company, St. Paul, Minn., are also possible sheeting materials.

Post-it® brand flags and index tabs are discrete, flexible sheets which have a first major side and a second major side. The Post-it® brand flags and index tabs have varying degrees of stiffness. Some Post-it® brand flags and index tabs are extremely flexible and some are designed to have greater stiffness. Each Post-it® brand flag sheet is typically elongated with a first end and a second end. Typically, the substrate polymer material for the sheet is flexible and generally transparent, as is the adhesive (disposed adjacent the first end). On its first major side (back side), adhesive is provided adjacent a first end of the elongated sheet (typically on at least half or a major portion of the back side of the sheet). Adjacent its second end, the sheet is typically provided with a visible indicator of contrasting color. In one example, this may be an inked color covering a tab portion of the second end of the sheet (on either side thereof) or a pre-printed image or message. Post-it® brand flags and index tabs are typically used as temporary indicators for pages in books or documents, or portions of documents, that are to be noted by a reader. Typically, that portion of the sheet which bears the adhesive is sufficiently transparent when adhered to a page so that underlying text on the page may be perceived and read. Often, an indicator image (such as arrow) is printed on the first transparent portion of the sheet to enhance its use as an indicator of sections of a page to which it is adhered. Further embodiments of the sheets may include sheer or transparent material bearing a distinctive color ink.

Repositionable pressure-sensitive adhesives (PSAs) are well known in the art as evidenced by U.S. Pat. Nos. 5,045,569; 4,988,567; 4,994,322; 4,786,696; 4,166,152; 3,857,731; and 3,691,140, the disclosures of which are incorporated herein by reference. A repositionable PSA typically comprises polymeric microspheres having an average diameter of at least one micrometer. The microspheres are inherently tacky and typically comprise of least about 70 parts by weight of an alkyl acrylate or alkyl methacrylate ester. A majority of the microspheres may contain interior voids, typically, at least about 10 percent of the diameter of the microsphere. Repositionable PSAs are tacky to the touch and typically demonstrate a peel adhesion to a glass substrate of approximately 10 to 300 gram/centimeters (g/cm), more typically approximately 50 to 250 g/cm, or even more typically about 70 to 100 g/cm. Peel adhesion can be determined according to the test outlined in U.S. Pat. No. 5,045,569. A repositionable PSA can be applied to sheeting using known methods including making a suspension of the microspheres and applying that suspension to the sheeting by conventional coating techniques such as knife coating or Meyer bar coating or use of an extrusion die (see U.S. Pat. No. 5,045,569 at col. 7, lines 40–50). Other methods to create repositionable adhesive coatings are well known in the art and may include: printing a fine pattern of adhesive dots; selective detackification of an adhesive layer; and incorporating nontacky microspheres in an adhesive matrix.

Figure 6:
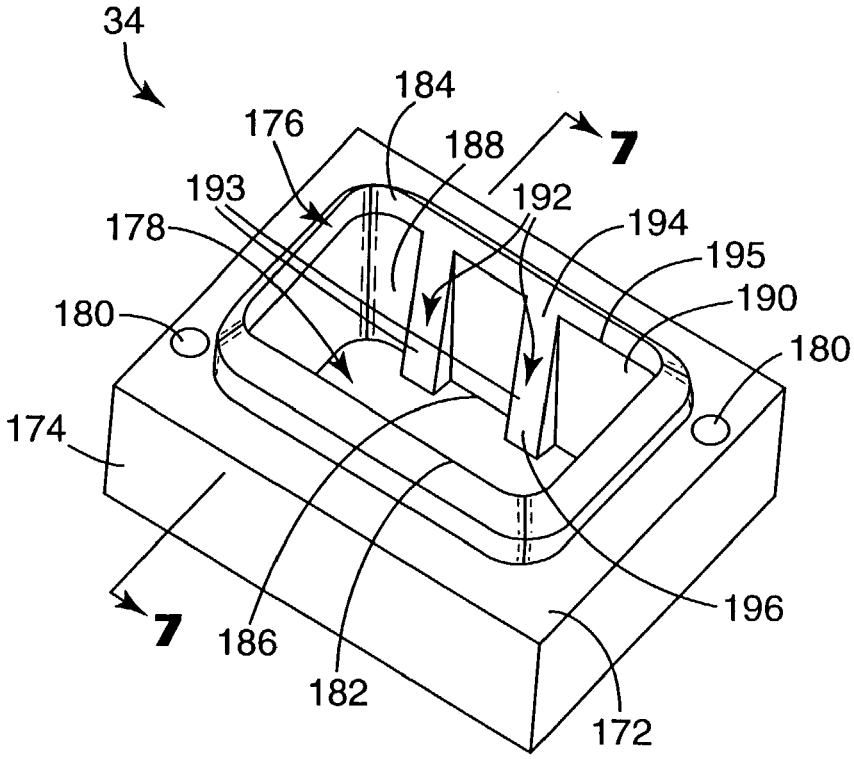
FIG. 6 is a top perspective view of one embodiment of the die for use in the pad forming process.
Figure 8:
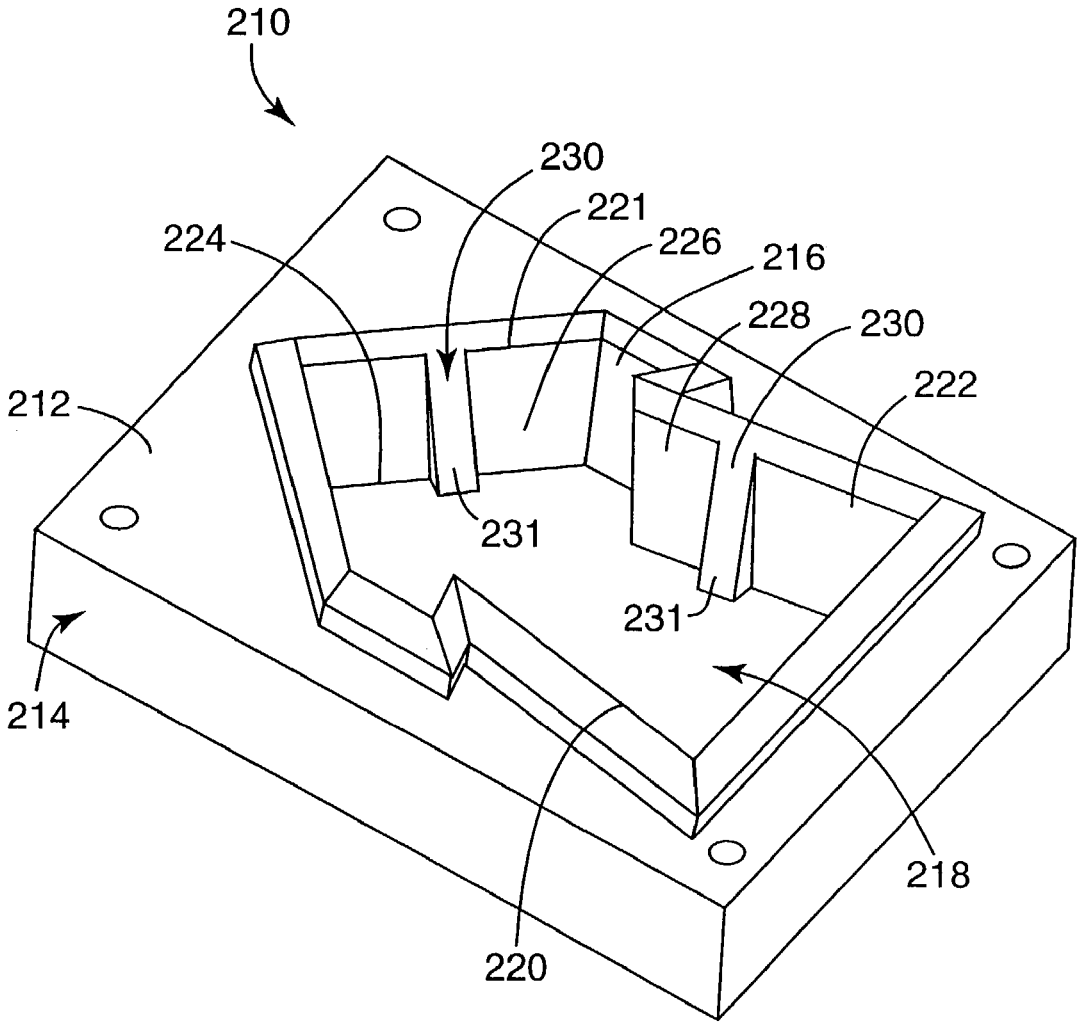
FIG. 8 is a top perspective view of another embodiment of the die padder for use in the pad forming process.

FIG. 6 is a top perspective view of an embodiment of the die padder 34 for use in the pad forming process. The die padder 34 (i.e., the die of the die assembly 12) defines a shape of the cut sheets. The die 34 has a die body 172 defined by an outer perimeter 174 and an inner perimeter 176. The inner perimeter 176 defines a sheet collection cavity 178 of the die 34 and also defines the shape of the cut sheets. Although the sheet collection cavity 178 shown in FIG. 6 shows a substantially rectangular shape, any number of shapes may be defined by the die 34 for forming the cut sheets. One example is an arrow (such as shown in FIG. 8), although those skilled in the art will recognize many other shapes may be defined. Bores 180 in the die body 172 are adapted to receive fasteners (not shown), which secure the die 34 to the lower stage 76.

The die 34 has a cutting edge 182 at a first end 184 of the sheet collection cavity 178 and a discharge edge 186 at an opposite, second end 188 of the sheet collection cavity 178. The web advances through the cutting station and past the cutting edge 182 of the die 34. Although not shown in FIG. 6, the anvil is located in a parallel plane spaced apart from the cutting edge 182 (see the relationship of the anvil 36 and die 34 illustrated in FIGS. 2 and 3). The cutting edge 182 cuts the web sheeting as it advances past the die 34. The weed sheeting continues to advance to the discharge end of the housing and the cut sheet is captured and retained within the sheet collection cavity 178.

The inner perimeter 176 of the die 34 defines a sheet retention surface formed to retain a desired number of cut sheets within the sheet collection cavity 178. The retention surface 176, as shown in FIG. 6, preferably includes at least two ribs 192, on each longitudinal side thereof, with each rib 192 extending from adjacent the cutting edge 182 of the cavity 178 to the discharge edge 186 of the cavity 178. Each rib 192 has an end 194 adjacent the cutting edge 182 and an end 196 adjacent the discharge edge 186. A face 193 of each rib 192 extends perpendicular to the cutting edge 182 and parallel to the other faces 193. Faces 193 retain the cut sheets within the cavity 178. A passive surface 190, not including the ribs 192, tapers from a first end 195 adjacent the cutting edge 182 of the die 34 to the discharge edge 186, outwardly toward the outer perimeter 174. The passive surface 190 has a taper of about one degree with respect to the faces 193 of the ribs 192. While FIG. 6 shows ribs extending from end 195 to discharge edge 186, further embodiments of the ribs may be shorter or longer, i.e., extend more or less with respect to the cutting edge 182 and the discharge edge 186. Those skilled in the art will recognize that different embodiments of the retention surface 176 may be utilized (often dependent on the die shape), for example, more or less ribs may be used, ribs of different shapes, different rib angles, curved surfaces, stepped surfaces, a roughened surface, or other geometric patterns formed on the inner perimeter surface, such as a plurality of bumps, dots, curves or lines. In general, surface 176 creates the desired amount of friction to retain cut sheets within the sheet collection cavity 178.

Figure 7:
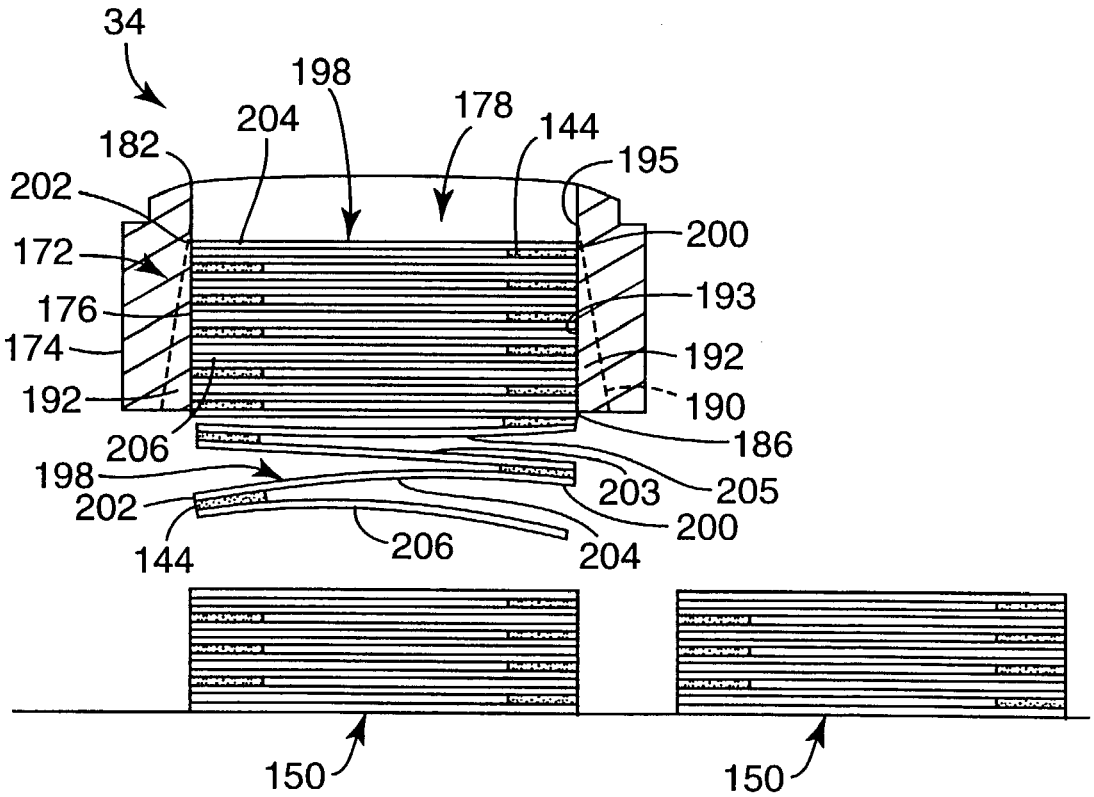
FIG. 7 is a sectional view of the die taken along line 7—7 of FIG. 6, with cut sheets shown therein.

FIG. 7 is a sectional view of the die 34 shown in FIG. 6 taken along line 7—7, including cut sheets 198 retained within the sheet collection cavity 178 of the die 34. FIG. 7 also illustrates shaped pads 150 which have been formed in and then ejected from the die 34. In addition, the cut sheets 198 in FIG. 7 are formed from a pad forming process utilizing at least two (or any even number) elongated linerless sheetings to form the web advancing through the cutting station.

In the embodiment shown in FIG. 7, on every other cut sheet 198 the adhesive 144 is positioned adjacent a first longitudinal edge 200 of the sheet 198. On the remaining cut sheets, the adhesive 144 is positioned adjacent a second longitudinal edge 202 of the sheet 198, opposite the first edge 200. As the cut sheets 198 adhere together sequentially and thus form a pad or stack within the sheet collection cavity 178 of the die 34, the adhesive 144 position alternates between the first edge 200 and the second edge 202 for adjacent sheets 198, thereby forming a Z-folded pad.

The position of the adhesive 144 on opposite edges 200, 202 of adjacently stacked cut sheets 198 is defined by the positioning of the adhesive 144 on the web sheeting. In a process utilizing two sheeting stock rolls, the first stock roll has adhesive placed adjacent a first longitudinal edge of the sheeting and the second stock roll has adhesive positioned a second longitudinal edge thereof, opposite the first edge. As shown in FIG. 5, the two sheetings adhere together to form a single web which advances past the die. Both sheetings are cut at the same time to form two cut sheets. In alternative embodiments of the present invention, the adhesive may be placed on the same edge of each sheeting, and similar to a process utilizing a single web, the cut sheets 198 will stack within the cavity 178 with the adhesive thereon positioned adjacent the same edge of each cut sheet 198.

Each cut sheet 198 is comprised of a substrate 204 and the adhesive 144. The cut sheet has a first side 203 and a second side 205, with the substrate 204 bearing the adhesive 144 on the second side 205. After a sheet is cut from the web sheeting, it is captured within the sheet collection cavity 178 and retained within the cavity by the retention surface 176 (or face 193 of rib 192 in FIG. 7). The cut sheet 198 is retained within the sheet collection cavity 178 and the adhesive 144 thereon adheres to the first side 203 of the substrate 204 of an adjacent cut sheet 198 to stack cut sheets and form a pad 150 as more cut sheets are added. A backing sheet 206, or a cut sheet with deactivated adhesive, separates one pad of sheets from a subsequent pad of sheets or previous pad of sheets, depending upon the orientation of the sheeting. In an alternate embodiment of the present invention, the adhesive 144 is positioned upon an entire side of the substrate 204.

As additional cut sheets 198 are captured within the collection cavity 178, the pad is forced toward the discharge edge 186 of the die 34. The bottommost cut sheets 198 of the pad 150 adjacent the discharge edge 186 of the collection cavity 178 extend out of the die 34 until the entire pad 150 is discharged from the die 34. Once a desired number of cut sheets 198 are captured within the collection cavity 178, the weight of the pad 150 combined with the force of subsequently added cut sheets, gravity, surface 176 and a break in adhesive between adjacent sheets (due to, for example, deactivated adhesive or backing sheet 206) forces the bottommost pad 150 to eject from the discharge end of the die 34. The ejected pad 150 lands on a conveyor line or other pad collection equipment to discharge the pad 150 from the cutting station 10. In an alternate embodiment of the present invention where the die 34 is associated with the upper drive assembly 28 and the anvil is associated with the lower drive assembly 30, the pad 150 is pushed up through the die 34 and is picked off to discharge the pad 150 from the cutting station 10. It should be understood that while a "Z fold" type pad is illustrated in FIG. 7, the operation of the die would occur in the same general manner for any adhesive configuration.

FIG. 8 is a top perspective view of another embodiment of a padder die 210 for use in the present invention. The die 210 forms cut sheets having an arrow shape. The die 210 has a die body 212 defined by an outer perimeter 214 and an inner perimeter 216. The inner perimeter 216 defines a sheet collection cavity 218 of the die 210 and the shape of the cut sheets. The die 210 has a cutting edge 220 at a first end 222 of the sheet collection cavity 218 and a discharge edge 224 at an opposite, second end 226 of the sheet collection cavity 218. The inner perimeter 216 of the die 210 also defines a retention surface formed to retain cut sheets within the collection cavity 218. The surface 216 shown in FIG. 8 is comprised of at least one rib 230 which extends from adjacent the cutting edge 220 to the discharge edge 224. A face 231 of each rib 230 extends perpendicular to the cutting edge 220 and parallel to the other faces 231. Cut sheets are retained within the cavity 218 by faces 231. A passive surface 228 tapers from a first end 221 adjacent the cutting edge 220 to the discharge edge 224, outwardly toward the outer perimeter 214 with respect to the faces 231 of the ribs 230.

The present invention is, in one form, a method for forming a shaped pad of cut sheets, each sheet bearing an adhesive on one side thereof. A die is provided having an outer perimeter, an inner perimeter defining a sheet collection cavity and a cutting edge. A web is advanced past the cutting edge of the die wherein the web has one side at least partially covered with an adhesive. A first sheet is cut from the web with the die and retained within the sheet collection cavity wherein a shape of the first cut sheet is defined by the sheet collection cavity. The web continues to advance past the cutting edge of the die and a subsequent sheet is cut from the web with the die. The shape of the subsequent cut sheet is defined by the sheet collection cavity. The subsequent cut sheet is retained within the sheet collection cavity wherein the subsequent cut sheet adheres to a previous cut sheet. The web continues to advance past the cutting edge and additional sheets are cut from the web until a desired number of cut sheets are adhered together to form a shaped pad of cut sheets. Once a desired number of cut sheets are retained within the collection cavity, a shaped pad is ejected from the die.

In alternative embodiments of the present invention, the web is defined as a first web and a second web is advanced past the cutting edge of the die. The second web has one side at least partially covered with an adhesive. The first and second webs are aligned to be generally parallel as they are advanced past the cutting edge of the die. In further embodiments, multiple webs may be put together before advancing past the die for processing. In one embodiment, each web has longitudinal edges, wherein the adhesive on the web extends adjacent the same longitudinal edge on each web. In another embodiment, each web has first and second longitudinal edges, wherein the adhesive on the first web extends adjacent the first edge thereof and the adhesive on the second web extends adjacent the second edge thereof.

In further alternative embodiments of the present invention, a portion of the adhesive on the one side of the web is deactivated, prior to cutting the web with die. The deactivated portion of the adhesive differentiates one shaped pad from a subsequent shaped pad.

Although the present invention has been described with reference to preferred embodiments, workers skilled in the art will recognize that changes may be made in form and detail without departing from the spirit and scope of the invention.

The invention claimed is:

1. A method for forming a stack of sheets, the method compnsing:

providing a sheet cutting die having a cutting edge and a sheet collection cavity therein;

providing an anvil having a planar surface extending to at least the cutting edge of the sheet cutting die;

advancing a web past the die wherein the web comprises a first linerless elongated sheeting having one side at least partially covered with an adhesive;

cutting the web with the die and the anvil to form a first cut sheet from the web within the sheet collection cavity of the die;

advancing the web past the die;

moving the die eccentrically at approximately the same speed as the web is advanced passed the die; and cutting the web with the die and the anvil to form a second cut sheet from the web within the sheet collection cavity of the die, wherein the second cut sheet adheres to the first cut sheet within the sheet collection cavity to form a stack of sheets.

2. The method of claim 1 wherein the die comprises an outer perimeter, an inner perimeter defining the sheet collection cavity and a first cutting edge wherein the inner perimeter defines a surface formed to retain a desired number of cut sheets within the sheet collection cavity.

3. The method of claim 1 wherein the adhesive comprises a repositionable pressure sensitive adhesive.

4. The method of claim 1 wherein the sheet collection cavity defines a shape of each cut sheet.

5. The method of claim 1, and further comprising ejecting the stack of cut sheets from the sheet collection cavity after a desired number of cut sheets adhere together.

6. The method of claim 1, and further comprising:

applying a backing sheet to a portion of the web, which comprises a bottom sheet of the stack of sheets, on the side thereof bearing the adhesive, prior to cutting the web, wherein the backing sheet is cut with the web by the die.

7. The method of claim 1, and further comprising:

detackifying the adhesive on a portion of the web, which comprises a bottom sheet of the stack of sheets, prior to cutting the web.

8. The method of claim 1 comprising:

advancing a second linerless elongated sheeting having one side at least partially covered with an adhesive; and aligning the first and second linerless elongated sheeting to be generally parallel as they are advanced past the die.

9. The method of claim 8 wherein each sheeting has first and second longitudinal edges, and wherein the adhesive on the first sheeting extends adjacent the first edge thereof and the adhesive on the second sheeting extends adjacent the second edge thereof.

10. The method of claim 8 wherein each sheeting has longitudinal edges, and wherein the adhesive on the sheeting extends adjacent the same longitudinal edge on each sheeting.

11. A method for forming a shaped pad of cut sheets, the method comprising:

providing a die having an outer perimeter, an inner perimeter defining a sheet collection cavity, and a cutting edge;

providing an anvil having a planar surface extending to at least the cutting edge of the sheet cutting die;

advancing a web past the cutting edge of the die wherein the web comprises a first linerless elongated sheeting having one side at least partially covered with an adhesive;

moving the die eccentrically at approximately the same speed as the web is advanced passed the die;

cutting a first cut sheet from the web with the die and the anvil wherein a shape of the first cut sheet is defined by the cutting edge;

retaining the first cut sheet within the sheet collection cavity;

advancing the web past the cutting edge of the die;

moving the die eccentrically at approximately the same speed as the web is advanced passed the die;

cutting a subsequent cut sheet from the web with the die and the anvil wherein a shape of the subsequent cut sheet is defined by the cutting edge; and retaining the subsequent cut sheet within the sheet collection cavity wherein the subsequent cut sheet adheres to a previous cut sheet.

12. The method of claim 11, and further comprising:

advancing the web past the cutting edge of the die, cutting a subsequent cut sheet from the web with the die;

and retaining the subsequent cut sheet within the sheet collection cavity wherein the subsequent cut sheet adheres to a previous cut sheet until a desired number of cut sheets are adhered together to form a shaped pad of cut sheets.

13. The method of claim 12 wherein a plurality of shaped pads of cut sheets are formed, and further comprising:

repeating the advancing steps, the cutting steps and the retaining steps until a desired number of shaped pads are formed.

14. The method of claim 12, and further comprising:

ejecting the shaped pad from the sheet collection cavity when a desired number of cut sheets are retained within the sheet collection cavity.

15. The method of claim 11 wherein the adhesive is a repositionable pressure sensitive adhesive.

16. The method of claim 11 wherein the inner perimeter comprises a sheet retention surface adapted to retain a desired number of cut sheets within the sheet collection cavity.

17. The method of claim 16 wherein the sheet retention surface comprises at least one rib formed on the inner perimeter, each rib extending from adjacent the cutting edge to adjacent an opposite, discharge edge.

18. The method of claim 11, and further comprising:

deactivating a portion of the adhesive on the one side of the web, which comprises a bottom sheet of the stack of sheets, prior to cutting the web, with the die wherein the deactivated portion of the adhesive differentiates the shaped pad from a subsequent shaped pad.

19. The method of claim 18 wherein the deactivating step comprises applying a liner to a portion of the web, which comprises a bottom sheet of the stack of sheets, on the side thereof bearing the adhesive, prior to cutting the web, with the die wherein the liner is cut with the web.

20. The method of claim 19 and further comprising:

removing the liner after the shaped pad is formed.

21. The method of claim 11 comprising:

advancing a second linerless elongated sheeting having one side at least partially covered with an adhesive; and aligning the first and second linerless elongated sheeting to be generally parallel as they are advanced past the die.

22. The method of claim 21 wherein the each sheeting has longitudinal edges, and wherein the adhesive on the sheeting extends adjacent the same longitudinal edge on each sheeting.

23. The method of claim 21 wherein each sheeting has first and second longitudinal edges, and wherein the adhesive on the first sheeting extends adjacent the first edge thereof and the adhesive on the second sheeting extends adjacent the second edge thereof.

* * * * *